US010947706B2

(12) United States Patent
Luig et al.

(10) Patent No.: US 10,947,706 B2
(45) Date of Patent: Mar. 16, 2021

(54) BURIED INSTALLATION BODY FOR A SANITARY FITTING, HAVING A TWO-PART HOUSING

(71) Applicant: Grohe AG, Hemer (DE)

(72) Inventors: Frank-Thomas Luig, Menden (DE); David Mainka, Iserlohn (DE); Dajana Lazic, Iserlohn (DE); Sebastian Althoff, Menden (DE)

(73) Assignee: Grohe AG, Hemer (DE)

( * ) Notice: Subject to any disclaimer, the term of this patent is extended or adjusted under 35 U.S.C. 154(b) by 15 days.

(21) Appl. No.: 16/512,957

(22) Filed: Jul. 16, 2019

(65) Prior Publication Data

US 2019/0338498 A1 Nov. 7, 2019

Related U.S. Application Data

(63) Continuation of application No. PCT/EP2018/050969, filed on Jan. 16, 2018.

(30) Foreign Application Priority Data

Jan. 16, 2017 (DE) ..... 10 2017 100 710.5

(51) Int. Cl.
*E03C 1/02* (2006.01)

(52) U.S. Cl.
CPC ..... *E03C 1/021* (2013.01)

(58) Field of Classification Search
CPC ..... E03C 1/021; E03C 1/023
USPC ..... 4/696
See application file for complete search history.

(56) References Cited

U.S. PATENT DOCUMENTS

| | | | | |
|---|---|---|---|---|
| 2017/0002551 | A1* | 1/2017 | Zhou | E03C 1/04 |
| 2017/0059053 | A1* | 3/2017 | Aykens | F16K 27/065 |
| 2018/0051839 | A1* | 2/2018 | Kanizo | F16L 37/0982 |
| 2018/0073223 | A1* | 3/2018 | Colombo | E03C 1/021 |

FOREIGN PATENT DOCUMENTS

| | | | |
|---|---|---|---|
| DE | 4038418 | A1 | 6/1992 |
| DE | 4217529 | A1 | 12/1993 |
| DE | 102011051739 | A1 | 1/2013 |
| EP | 2636803 | A2 | 9/2013 |

OTHER PUBLICATIONS

International Search Report dated Jun. 15, 2018 in corresponding application PCT/EP2018/050969.

* cited by examiner

*Primary Examiner* — Huyen D Le
(74) *Attorney, Agent, or Firm* — Muncy, Geissler, Olds & Lowe, P.C.

(57) ABSTRACT

A buried installation body for a sanitary fitting having a housing with a receiving space for a functional unit, wherein the housing has a lower shell and an upper shell which are connectable to each other, and a connection body having at least a first connection for a supply line and at least a second connection for a discharge line, wherein the connection body is at least partially arranged in the receiving space of the housing, and wherein the connection body is fastened by the connection of the lower shell with the upper shell in the receiving space.

8 Claims, 2 Drawing Sheets

BURIED INSTALLATION BODY FOR A SANITARY FITTING, HAVING A TWO-PART HOUSING

This nonprovisional application is a continuation of International Application No. PCT/EP2018/050969, which was filed on Jan. 16, 2018, and which claims priority to German Patent Application No. 10 2017 100 710.5, which was filed in Germany on Jan. 16, 2017, and which are both herein incorporated by reference.

BACKGROUND OF THE INVENTION

Field of the Invention

The present invention relates to a flush-mounted body for a sanitary fitting, which can be fastened inside a wall breakthrough, a cavity in a wall or another type of support. In particular, in built-in walls and pre-wall systems such flush-mounted bodies have proven to be successful.

Description of the Background Art

Flush-mounted bodies serve to attach a functional unit in a stone wall, a wall or a support. The functional unit may comprise a thermostat cartridge and/or a valve. By means of the thermostat cartridge, a cold water and a hot water are miscible to a mixed water with a desired mixed water temperature, wherein the volume of the mixed water to be removed can be controlled by means of the valve. At least one mixed water line can be connected to the flush-mounted body via which the mixed water of the sanitary fitting, such as a hand-held shower head, overhead shower head, nozzle, spout and/or the like, on a shower and/or bathtub, can be supplied. The cold water connection is normally connectable with a cold water house connection and the hot water connection is normally connectable with a hot water house connection via appropriate pipes. Known flush-mounted bodies, however, have a complex structure, which leads to high installation costs.

SUMMARY OF THE INVENTION

It is therefore an object of the present invention to solve at least partially the problems described with reference to the prior art and, in particular, to specify a flush-mounted body, which can be produced with low installation costs.

In an exemplary embodiment, a flush-mounted body for a sanitary fitting includes: a housing with a receiving space for a functional unit, wherein the housing comprises a lower shell and an upper shell, which are connectable to each other; and a connection body with at least one first connection for a supply line and at least one second connection for a discharge line, wherein the connection body is arranged at least partially in the receiving space of the housing, and wherein the connection body can be fastened in the receiving space by means of the connection of the lower shell to the upper shell.

The flush-mounted body is in particular used for sanitary fittings, which are used in conjunction with showers and or bathtubs. The sanitary fittings may in particular be water spouts, hand-held shower heads, overhead shower heads, nozzles and/or the like. Such flush-mounted bodies are generally mounted inside a wall breakthrough, a cavity in a wall or another support and serve to accommodate a functional unit. The functional unit comprises in particular a thermostat cartridge and at least one valve. By means of the thermostat cartridge, in particular a cold water and a hot water are miscible to a mixed water with a desired mixed water temperature. The cold water can have a cold water temperature, which is in particular at most 25° C. (Celsius), preferably 1° C. to 25° C., particularly preferably 5° C. to 20° C. The hot water can have a hot water temperature, which is in particular not more than 90° C., preferably 25° C. to 90° C., particularly preferably 55° C. to 65° C. The mixed water can be supplied from the thermostat cartridge, for example, via at least one line in the functional unit to the at least one valve, by means of which the volume of the mixed water to be removed is controllable via the sanitary fitting. The functional unit is arranged in particular at least partially in a receiving space of a housing of the flush-mounted body and/or is substantially cylindrical.

The housing can have a lower shell and an upper shell, which are connectable to each other. The lower shell is in particular formed as a cap, so that by means of the lower shell an end-side opening of the upper shell is closeable (in a liquid-tight manner). To this end, the lower shell can have first fastening tabs, which in particular radially extend outwards. In contrast, the upper shell is in particular shaped in a tubular manner, so that the upper shell forms a receiving space for the functional unit in its interior. In addition, the upper shell may have second fastening tabs, which can also extend in the radial direction. The lower shell and the upper shell can be screwed together in particular via the first fastening tabs and the second fastening tabs. Additionally, or alternatively, the lower shell and/or the upper shell may have snap arms with which the lower shell and the upper shell can be latched together.

The flush-mounted body also has a connection body with at least a first connection for a supply line (for example for the cold water and/or hot water) and at least a second connection for a discharge line (for example for the mixed water). The connection body is made in particular of (cast) metal and/or has a (through) opening, in which the functional unit can be fastened. In particular, a house connection for the cold water or hot water can be connected to the sanitary fitting at the at least one first connection, and/or a mixed water pipe for discharging the mixed water can be connected to the sanitary fitting at the at least one second connection. For this purpose, the at least one first connection and/or the at least one second connection have a thread. The connection body is at least partially disposed in the receiving space of the housing. By connecting the lower shell with the upper shell, the connection body is fastened in the receiving space. The fastening of the connection body in the receiving space takes place in particular by a tensioning of the connection body between the lower shell and the upper shell. With this configuration, the flush-mounted body can be produced with low installation costs, in particular in automated production lines.

In addition, it is advantageous if the connection body is fastened positively in the receiving space by means of the lower shell and the upper shell. As a result, the connection body can be fastened particularly securely in the receiving space.

It is also advantageous if the lower shell has a first circumferential groove which adjoins a first end face of the connection body. In particular, the first circumferential groove is annular.

A first seal can be arranged in the first circumferential groove, which seals the receiving space against an environment. The first seal may be, for example, an O-ring or preferably, a sealant or adhesive. The use of a sealant or adhesive has the advantage that, in contrast to an O-ring, the former introduces no or only low forces into the lower shell and the upper shell in the direction of a longitudinal axis of a flush-mounted body, so that the connection between the lower shell and the upper shell can be made less stable.

The upper shell can have a second circumferential groove which adjoins a second end face of the connection body. The second end face is in particular located opposite the first end face of the connection body. In addition, the second circumferential groove is also in particular annular.

A second seal can be arranged in the second circumferential groove, which seals the receiving space from an environment. The second sealant is in particular an O-ring or preferably, a sealant or adhesive. Also with the second circumferential groove, the use of a sealant or adhesive has the advantage that compared to an O-ring, the former introduce no or only small forces into the lower shell and the upper shell in the direction of the longitudinal axis of the flush-mounted body, so that the connection between the lower shell and the upper shell can be made less stable.

In addition, it is advantageous if the connection body is annular. It should be clarified here that the connection body does not necessarily need to be annular, but instead may also be, for example, polygonal, square or rectangular in cross section. As a result of this configuration, material for the connection ring, such as for example (cast) metal, can be saved in comparison to the usual cup-shaped connection bodies, so that the connection ring is particularly easy to design. In addition, the space required for the connection ring in the housing of the flush-mounted body is reduced.

Furthermore, it is advantageous if on a circumferential surface, the connection body has a cold water connection, a hot water connection, a first mixed water connection, a second mixed water connection and a third mixed water connection. The cold water connection and the hot water connection are in particular the first connections of the connection body. The first mixed water connection, the second mixed water connection and the third mixed water connection are, in particular, second connections of the connection body. The flush-mounted body is in particular connectable with the cold water house connection via the cold water connection, and with the hot water house connection via the hot water connection. The cold water supplied via the cold water connection and the hot water supplied via the hot water connection can in particular be fed to the thermostat cartridge of the functional unit and miscible by said unit to a mixed water with a desired mixed water temperature. The mixed water can then be supplied to a first valve, second valve and third valve of the functional unit, by means of which the discharge of the mixed water is controllable via the first mixed water connection, the second mixed water connection and/or the third mixed water connection. A first sanitary fitting can be connected to the first mixed water connection, a second sanitary fitting can be connected to the second mixed water connection and/or a third sanitary fitting to the third mixed water connection.

The connection body can have a longitudinal axis, a first connection axis oriented orthogonally to the longitudinal axis and a second connection axis that is oriented orthogonally to the longitudinal axis and the first connection axis, wherein the cold water connection, the hot water connection and the first mixed water connection open into the connection body in parallel with the first connection axis, and wherein the second mixed water connection and the third mixed water connection open into the connection body in parallel with the second connection axis. By means of this configuration, a crossing of the supply line of the cold water and/or hot water with at least one discharge line for the mixed water can be avoided, thereby facilitating the installation of the flush-mounted body in the stone wall or wall.

The first mixed water connection can be arranged on a side of the connection body opposite the cold water connection and the hot water connection and wherein the second mixed water connection is arranged on a side of the connection body opposite the third mixed water connection.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
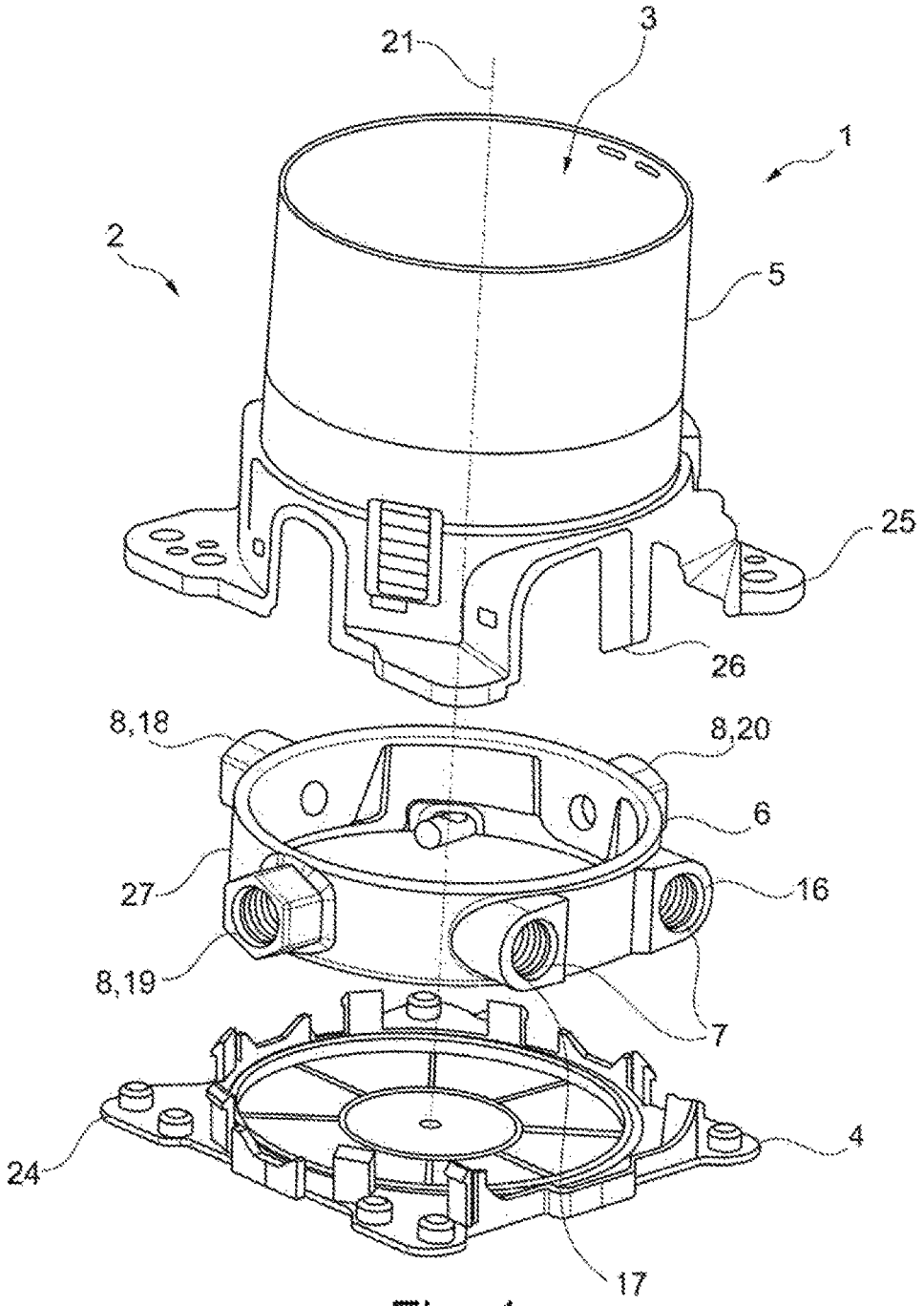
FIG. 1 is an exploded view of a flush-mounted body.

FIG. 1 shows an exploded view of a flush-mounted body 1 with a housing 2, which comprises a lower shell 4 and an upper shell 5. Here, the lower shell 4 is formed as a cap and the upper shell 5 is tubular. The housing 2 also has a receiving space 3 for a functional unit, not shown here. In addition, the flush-mounted body 1 has a connection body 6, which is annular. On a circumferential surface 27, the connection body has two first connections 7 in the form of a cold water connection 16 and a hot water connection 17. In addition, on the circumferential surface 27, the connection body 6 has a second connection 8 in the form of a first mixed water connection 18, a second connection 8 in the form of a second mixed water connection 19 and a second connection 8 in the form of a third mixed water connection 20. When installing the flush-mounted body 1, the connection body 6 is placed on the lower shell 4 and then the upper shell 5 is connected to the lower shell 4. For this purpose, the lower shell 4 has first fastening tabs 24 and the upper shell 5 has second fastening tabs 25, via which the lower shell 4 and the upper shell 5 van be latched, locked or screwed together. Furthermore, snap arms 26 are formed on the upper shell 5, which extend in parallel with a longitudinal axis 21 of the flush-mounted body. The orientation of the longitudinal axis 21 is defined by the extent of the tubular area of the upper shell 5 and/or by the annular connection body 6. The snap arms 26 can be latched to the lower shell 4. By connecting the lower shell 4 with the upper shell 5, the connection body 6 is fastened in the receiving space.

Figure 2:
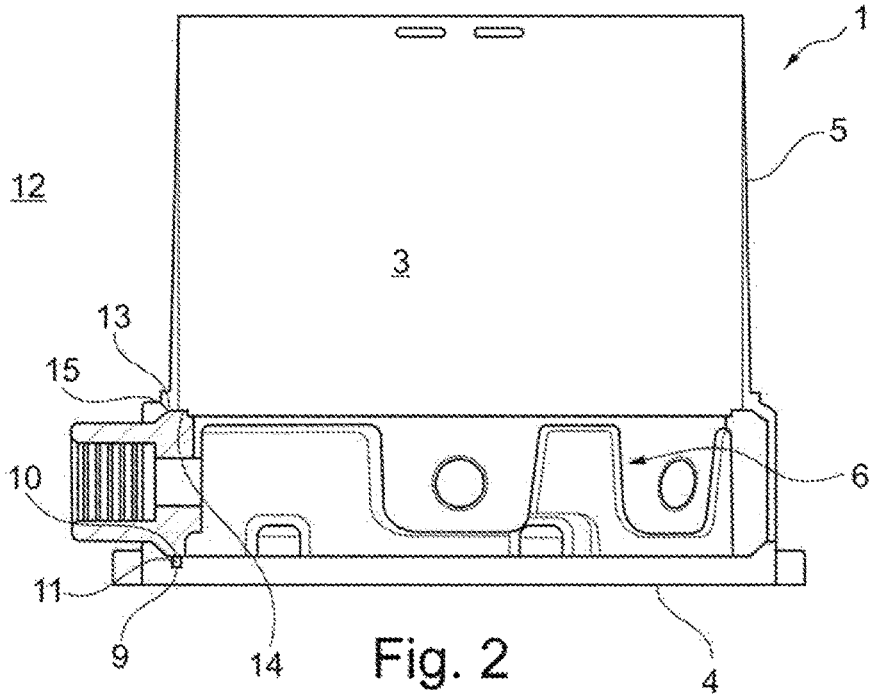
FIG. 2 shows the flush-mounted body in an installed state.

FIG. 2 shows the flush-mounted body 1 in the installed state. In the installed state, the connection body 6 is positively clamped between the lower shell 4 and the upper shell 5 in the receiving space 3. The lower shell 4 has a first circumferential groove 9, which is formed annular. The first circumferential groove 9 adjoins a first end face 10 of the connection body 6. In the first circumferential groove 9, a first seal 11 is positioned, which seals the receiving space 3 against an environment 12. Furthermore, the upper shell 5 has a second circumferential groove 13, which is also formed annular. The second circumferential groove 13 adjoins a second end face 14 of the connection body 6, which is located opposite the first end face 10 of the connection body 6. In the second circumferential groove 13, a second seal 15 is arranged, which also seals the receiving space 3 against the environment 12.

Figure 3:
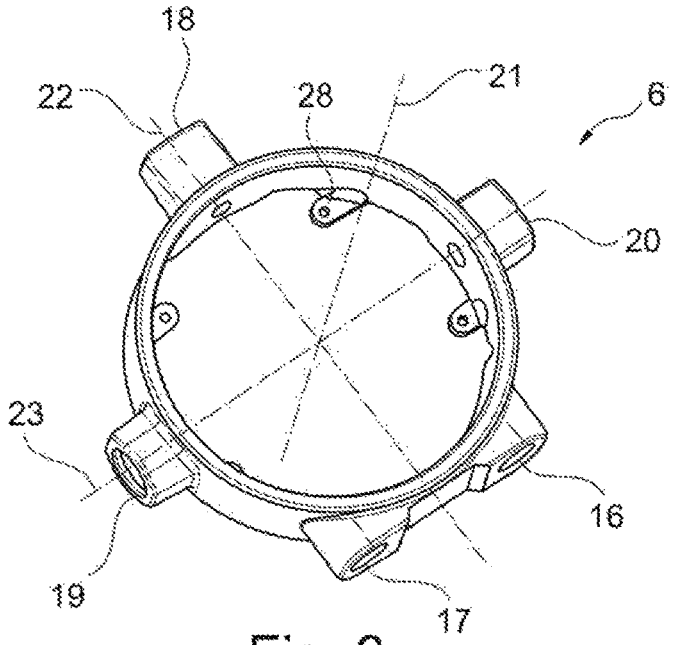
FIG. 3 is a perspective view of a connection body of the flush-mounted body.

FIG. 3 shows the connection body 6 in a perspective view. The connection body 6 has a first connection axis 22 oriented orthogonally to the longitudinal axis 21, and a second connection axis 23 oriented orthogonally to the longitudinal axis 21 and the first connection axis 22. The cold water connection 16, the hot water connection 17 and the first mixed water connection 18 open into the connection body 6 in parallel with the first connection axis 22. Furthermore, the second mixed water connection 19 and the third mixed water connection 20 open into the connection body 6 in parallel with the second connection axis 23. In addition, the first mixed water connection 18 is disposed on a side of the connection body 6 opposite the cold water connection 16 and the hot water connection 17 and the first mixed water connection 18 are disposed on a side of the connection body 6 opposite the third mixed water connection 20. The functional unit, not shown here, can be fastened to tabs 28 of the connection body 6, such that the cold water connection 16, the hot water connection 17, the first mixed water connection 18, the second mixed water connection 19 and the third mixed water connection 20 are connected to the functional unit in a leak-free manner.

The proposed flush-mounted body can be produced with very low installation costs.

The invention being thus described, it will be obvious that the same may be varied in many ways. Such variations are not to be regarded as a departure from the spirit and scope of the invention, and all such modifications as would be obvious to one skilled in the art are to be included within the scope of the following claims

What is claimed is:

1. A flush-mounted body for a sanitary fitting, the body comprising:

a housing with a receiving space for a functional unit, the housing comprising a lower shell and an upper shell that are connectable to each other; and a connection body with at least one first connection for a supply line and at least one second connection for a discharge line, the connection body being at least partially disposed in the receiving space of the housing, the connection body being adapted to be fastened in the receiving space due to the connection between the lower shell and the upper shell, wherein the at least one first connection and the at least one second connection are provided on a circumferential surface of the connection body, wherein the at least one first connection includes a cold water connection and a hot water connection, wherein the at least one second connection includes a first mixed water connection, a second mixed water connection and a third mixed water connection, wherein the connection body has a longitudinal axis, a first connection axis orthogonally oriented to the longitudinal axis and a second connection axis orthogonally oriented to the longitudinal axis and the first connection axis, wherein the cold water connection, the hot water connection and the first mixed water connection open into the connection body in parallel with the first connection axis, and wherein the second mixed water connection and the third mixed water connection open into the connecting body in parallel with the second connection axis, and wherein the first mixed water connection is disposed on a side of the connection body opposite the cold water connection and the hot water connection and wherein the second mixed water connection is arranged on a side of the connection body opposite the third mixed water connection.

2. The flush-mounted body according to claim 1, wherein the connection body is positively fastened in the receiving space via the lower shell and the upper shell.

3. The flush-mounted body according to claim 1, wherein the lower shell has a first circumferential groove, which adjoins a first end face of the connection body.

4. The flush-mounted body according to claim 3, wherein in the first circumferential groove, a first seal is arranged, which seals the receiving space from an environment.

5. The flush-mounted body according to claim 3, wherein the upper shell has a second circumferential groove, which adjoins a second end face of the connection body.

6. The flush-mounted body according to claim 5, wherein, in the second circumferential groove, a second seal is arranged, which seals the receiving space against an environment.

7. The flush-mounted body according to claim 1, wherein the connection body is formed annular.

8. The flush-mounted body according to claim 1, wherein the cold water connection and the hot water connection are provided on a same side of the connection body.

* * * * *